US008152575B2

(12) United States Patent
Boling et al.

(10) Patent No.: US 8,152,575 B2
(45) Date of Patent: Apr. 10, 2012

(54) GROUNDING LUG

(75) Inventors: Dale R. Boling, Avon, OH (US); Nicholas J. Ambrogio, Highland Heights, OH (US); Matthew Flemming, Medina, OH (US)

(73) Assignee: ERICO International Corporation, Solon, OH (US)

( * ) Notice: Subject to any disclaimer, the term of this patent is extended or adjusted under 35 U.S.C. 154(b) by 43 days.

(21) Appl. No.: 12/835,139

(22) Filed: Jul. 13, 2010

(65) Prior Publication Data

US 2011/0014824 A1 Jan. 20, 2011

Related U.S. Application Data

(60) Provisional application No. 61/225,316, filed on Jul. 14, 2009.

(51) Int. Cl.
*H01R 4/38* (2006.01)

(52) U.S. Cl. ..... 439/815; 439/92

(58) Field of Classification Search ..... 439/92, 439/95, 709, 806–815, 864
See application file for complete search history.

(56) References Cited

U.S. PATENT DOCUMENTS

| | | | | |
|---|---|---|---|---|
| 7,097,518 | B2 * | 8/2006 | Kraemer et al. | 439/806 |
| 7,326,069 | B1 | 2/2008 | Duesterhoeft | |
| 2007/0248434 | A1 | 10/2007 | Wiley et al. | |

* cited by examiner

*Primary Examiner* — Khiem Nguyen
(74) *Attorney, Agent, or Firm* — Renner, Otto, Boisselle & Sklar, LLP

(57) ABSTRACT

A grounding lug for holding a grounding wire includes a housing defining an opening for receiving a wire and a clamping pad movable relative to the housing. The clamping pad is movable between an unclamped position in which the clamping pad defines a wire-receiving pocket in combination with the opening defined by the housing, and a clamped position in which the clamping pad clamps the wire to the housing. The grounding lug also includes a moving mechanism coupled to the housing and the clamping pad for moving the clamping pad between the unclamped and clamped positions.

19 Claims, 4 Drawing Sheets

GROUNDING LUG

RELATED APPLICATIONS

This application claims the benefit of U.S. Provisional Application No. 61/225,316, filed Jul. 14, 2009, which is hereby incorporated herein by reference.

FIELD OF THE INVENTION

The present invention generally relates to hardware for an electrical fixture and more specifically, to a grounding conductor for a grounding wire.

DESCRIPTION OF THE RELATED ART

According to 2008 National Electrical Code Article 690.43, solar photovoltaic module frames and supporting structures must be grounded when installed. There currently are a few different options available to help meet this requirement. The most common option is a "direct-bury" lay-in lug, which is either extruded or cast, commonly from tinned copper. Direct-bury lugs were designed for other purposes, such as bonding metallic conduits, which make them less than ideal for running grounding conductors underneath strings of photovoltaic modules.

SUMMARY OF THE INVENTION

The present invention provides a grounding lug having a conductive housing, a clamping pad and a lay-in feature. The lay-in feature allows an installer to loosely place a grounding wire in the grounding lug, whereby the wire can be positioned and adjusted before final installation without disengagement of the clamping pad or removing the wire from the grounding lug. The lay-in feature therefore allows the installer significant freedom of movement during installation. For example, when the grounding lug is inverted and installed on the underside of a solar photovoltaic ("PV") module, the lay-in feature can support the grounding wire against gravity, thereby facilitating the installation of the wire by allowing the installer freedom to manipulate and place the wire without the wire falling out of the grounding lug.

Using the lay-in feature, an installer can freely place and arrange the grounding wire in a plurality of grounding lugs before final installation. Once a final arrangement of the grounding wire has been achieved, the installer can tighten the clamping pad of each of grounding lug to securely couple the grounding wire to the housing to ground each module.

The invention provides a grounding lug having a housing defining an opening for receiving a wire and a clamping pad movable relative to the housing. The clamping pad is movable between an unclamped position in which the clamping pad defines a wire-receiving pocket in combination with the opening defined by the housing, and a clamped position in which the clamping pad clamps the wire to the housing. The grounding lug also includes a moving mechanism coupled to the housing and the clamping pad for moving the clamping pad between the unclamped and clamped positions.

According to another aspect of the invention, a clamp or lug has an angled design to provide clearance for the use of power tools for mounting hardware installation and wire clamping operation.

According to one aspect of the present invention, an angled design of the grounding lug provides clearance for the use of tools for mounting the grounding lug onto a hardware installation (e.g., a PV module frame) and for moving the clamping pad to effect clamping of the wire between the clamping pad and the housing.

According to another aspect of the present invention, the clamping pad includes one or more tabs protruding from upper and/or lower portions of the clamping pad. The tabs can engage sidewalls of the housing as the clamping pad is moved between the unclamped and clamped positions to reduce or prevent side loads from acting on a base of the housing, which may cause sidewalls of the grounding lug to spread during ground wire installation and prevent adequate holding force between the clamping pad and the housing.

According to another aspect, a resilient member, such as a spring, can be used to facilitate the positioning of the clamping pad prior to installation. For example, the spring may resiliently bias the clamping pad to the unclamped position, but allow for movement of the clamping pad in the direction of the clamped position to facilitate installation of the grounding lug on the mounting frame.

According to another aspect, the housing and the clamping pad can have a stamped sheet metal design that allows the grounding lug to be manufactured by a relatively inexpensive stamping process from a broad variety of materials and alloys.

According to another aspect of the invention, a grounding lug or grounding clamp is made of stamped metal, such as stamped copper alloy or stainless steel.

According to a further aspect, all hardware of the lug and/or clamp is of the same drive style and size.

A major objective in the solar industry is to reduce the cost-per-watt for the manufacture and installation of PV modules. The grounding lug disclosed herein is relatively inexpensive to manufacture and can reduce installation times, leading to a reduced overall cost-per-watt when installed on solar PV modules and frames. In addition, the stamped lug can be supplied with the appropriate mounting hardware to help with proper installation and to help maintain grounding continuity for the life of the installation.

The foregoing and other features of the invention are hereinafter fully described and particularly pointed out in the claims, the following description and the annexed drawings setting forth in detail one or more illustrative embodiments of the invention, such being indicative, however, of but a few of the various ways in which the principles of the invention may be employed.

BRIEF DESCRIPTION OF THE DRAWINGS

In the annexed drawings, which are not necessarily to scale.

DETAILED DESCRIPTION

Figure 1:
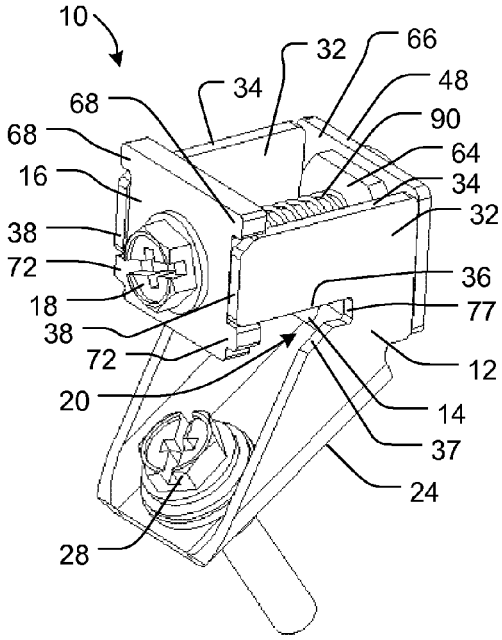
FIG. 1 is a front side perspective view of the grounding lug with a fastener for mounting the grounding lug on a mount frame.
Figure 2:
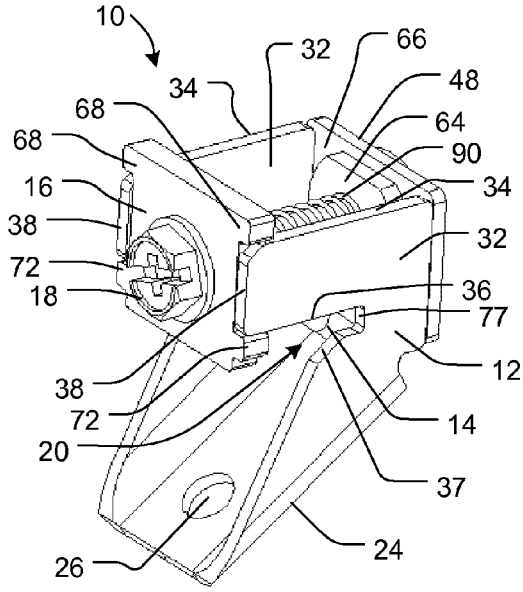
FIG. 2 is a front side perspective view of the grounding lug without the fastener of FIG. 1.
Figure 3:
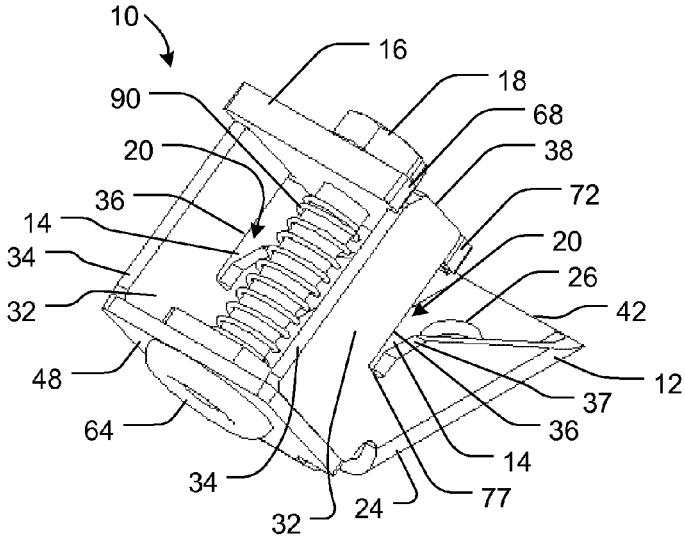
FIG. 3 is a rear side perspective view of the grounding lug of FIG. 2.

Referring now to the drawings in detail and initially to FIGS. 1-3, an exemplary grounding lug according to the invention is indicated generally at 10. The grounding lug 10 includes a housing 12 having an opening 14 (also referred to as a "lay-in slot" or a "slot") for receiving a wire (also referred to as a "grounding wire"), a clamping pad 16 (also referred to as a "grounding clamp") movable relative to the housing, and a moving mechanism 18 coupled to the housing 12 and the clamping pad 16. The moving mechanism 18 moves the clamping pad 16 between an unclamped position (shown in FIGS. 1-3) in which the clamping pad 16 defines a wire-receiving pocket 20 in combination with the opening 14, and a clamped position (shown in FIG. 14) in which the clamping pad 16 clamps the wire to the housing 12.

Figure 4:
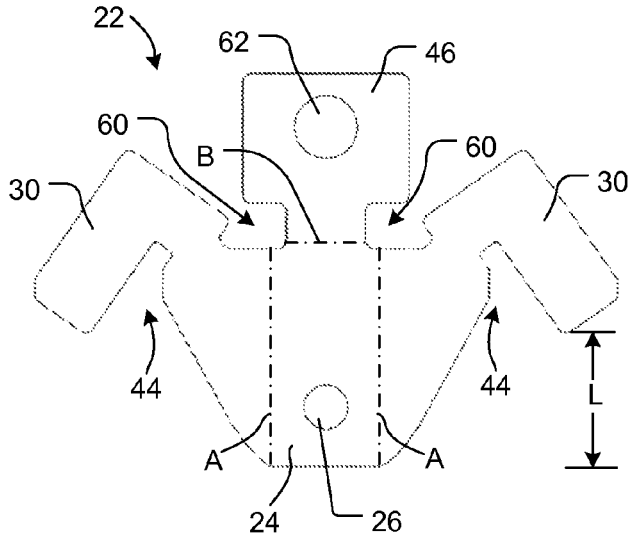
FIG. 4 is an exemplary blank for forming the housing of FIGS. 5A and 5B.
Figure 5A:
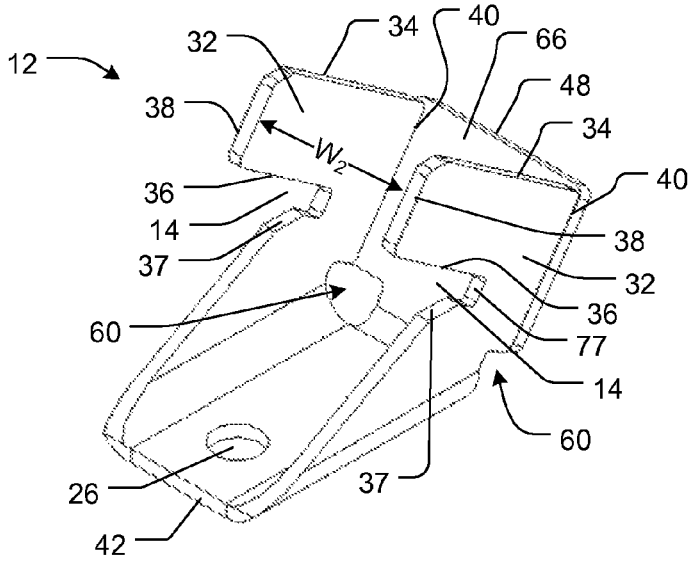
FIG. 5A is a front side perspective view of a housing.
Figure 5B:
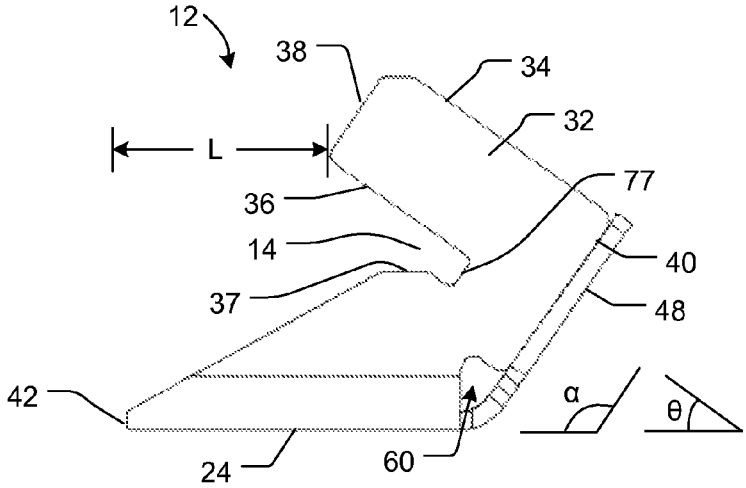
FIG. 5B is a side elevation view of the housing of FIG. 5A.

With additional reference to FIGS. 4, 5A and 5B, the housing 12 of the exemplary grounding lug 10 is shown in more detail. FIG. 4 shows an exemplary blank 22 for forming the housing 12 and FIGS. 5A and 5B show the housing 12 formed from the blank. The blank 22 may be manufactured from a stamping process for example, by stamping the blank 22 from sheet metal or another electrically conductive material, such as stamped copper alloy or stainless steel, for example.

The blank 22 has a base 24 having a through hole 26 stamped therein. The base 24 is generally planar and the through hole 26 is configured to capture mounting hardware, such as a fastener 28 or other fastening mechanism for mounting the base 24 to a piece of equipment, for example, as described below with respect to FIGS. 10-14. The mounting hardware also may include, for example, a lock washer, a flat washer and/or other hardware that may be used for mounting the lug on a piece of equipment.

The blank 22 also includes a pair of side panels 30, which may be substantially the same as one another. The side panels 30 are bent parallel to one another and generally perpendicular to the base 24 by folding the side panels 30 relative to the base 24 generally along lines A (FIG. 4) to form the sidewalls 32 of the housing 12 as shown in FIGS. 5A and 5B.

As shown in FIGS. 5A and 5B, the sidewalls 32 each have an upper edge 34, a lower edge 36, a front edge 38 and a rear edge 40. The upper edge 34 and lower edge 36 are generally parallel to one another and the front edge 38 and rear edge 40 are generally perpendicular to the upper edge 34 and lower edge 36. When the side panels 30 of the blank 22 (FIG. 4) are bent into the position of FIGS. 5A and 5B, the rear edges 40 are inclined relative to the base 24, as shown by angle $\alpha$ of FIG. 5B.

As shown in FIGS. 4 and 5B, the front edges 38 of the sidewalls 32 and the front edge 42 of the base 24 are offset from one another, as indicated generally by "L". The offset provides space for inserting and tightening the fastener 28 when the sidewalls 32 are folded parallel to one another. The offset may be sufficient so as to provide a space for a tool to tighten the fastener and to connect the grounding lug to a mount plate without significant interference from the sidewalls 32, clamping pad 16 and/or moving mechanism 18.

The side panels 30 are stamped with a generally V-shape cutout 44 (FIG. 4) that forms the opening 14 in each sidewall 32 when the blank 22 is folded to form the housing 12. The opening 14 in each sidewall 32 is defined in part by the lower edge 36 of the sidewall 32 and a portion 37 of the housing 12. Due to the generally V-shape cutout 44, the opening 14 has a widened or flared opening for receiving the wire.

As best shown in FIG. 5B, the lower edge 36 of the sidewall 32 defining the opening 14 is angled relative to the base 24. As described in more detail below with respect to FIGS. 10-14, the angle $\theta$ facilitates the installation and clamping of a wire in the opening 14 by providing space for the tools used to install the grounding lug 10 and for driving the moving mechanism 18 when the grounding lug 18 is mounted. In one embodiment, the opening 14 is at an acute angle relative to the base 24. The angle $\theta$ may be about 25°-60° and preferably is between about 30°-40°. The angle $\theta$ may be selected to provide an installer sufficient space to access and drive the fastener 28 and the moving mechanism 18. The angle $\theta$ also may be selected based upon an angle of inclination of a mount plate on which the grounding lug is mounted.

The blank 22 also includes a rear panel 46, which is folded relative to the base 24 generally along line B to form a rear wall 48 of the housing 12. To facilitate the folding of the rear panel 46 relative to the base 24, the blank 22 includes a pair of notches 60 between the base 24 and the rear panel 46. The rear panel 46 also includes a rear through hole 62 that may be threaded for receiving the moving mechanism 18. Additionally or alternatively, the rear through hole 62 may be configured for receiving a rivet 64, with the rivet 64 configured for coupling to the moving mechanism 18 to the housing 12.

The rear panel 46 may be bent so as to form an angle $\alpha$ with the base 24. For example, as shown in FIG. 4, the rear wall 48 forms an obtuse angle $\alpha$ with the base 24. The angle between the base 24 and the rear wall 48 facilitates the installation and clamping of a wire, especially when the grounding lug 10 is inverted and installed on the underside of a PV module, as described in more detail below.

As shown in FIG. 5A, the rear wall 48 of the housing 12 has a front face 66 that faces the rear edges 40 of the sidewalls 32 when the rear panel 46 is folded relative to the base 24. The front face 66 of the rear wall 48 may interface with the rear edges 40 of the sidewalls 32 to provide strength to the grounding lug 10 during grounding wire installation by preventing the rear wall 48 from deflecting inward (e.g., towards the clamping and grounding wire) as the moving mechanism 18 engages the housing 12 and moves the clamping pad 16 to the clamped position.

Although illustrated as being constructed from a stamping process, the housing 12 can be formed from other manufacturing techniques, including, for example, die casting, molding, etc.

Figure 6A:
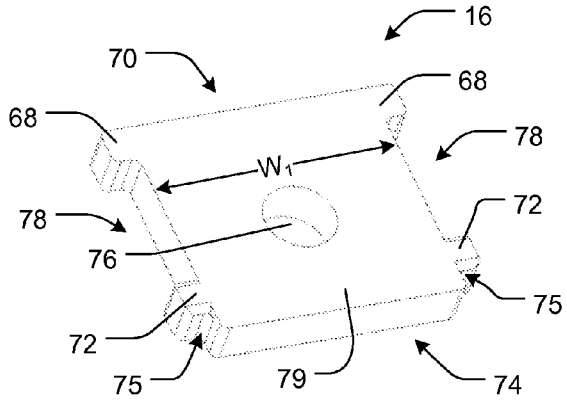
FIG. 6A is a perspective view of an exemplary embodiment of a clamping pad.

Referring now to FIG. 6A, an exemplary embodiment of the clamping pad 16 is shown. The clamping pad 16 can be stamped from sheet metal or another electrically conductive material, such as stainless steel. The clamping pad 16 may be the same material as the housing 12 or another suitable material that allows the clamping pad 16 to move or slide relative to the housing 12 so as to clamp a wire between the clamping pad 16 and the housing 12.

The clamping pad 16 has a width $W_1$ that is slightly less than a width $W_2$ (FIG. 5A) between the sidewalls 32 of the housing 12. The clamping pad 16 has a pair of outwardly protruding upper tabs 68 extending from an upper portion 70 of the clamping pad 16, and a pair of outwardly protruding lower tabs 72 extending from a lower portion 74 of the clamping pad 16. The upper tabs 68 slide along the upper edge 34 of the sidewall 32 and the lower tabs 72 slide along the lower edge 36 of the sidewall 32 when the clamping pad 16 is moved between the unclamped and clamped positions.

As shown in FIG. 6A, the upper tabs 68 extend from the top corners of the clamping pad 18. The lower tabs 72 may be offset from the bottom corners of the clamping pad 18 forming respective notches 75. The notches 75 accommodate the inside corner radii of the opening 14 thus allowing face 79 of the clamping pad 72 to contact the back surface 77 of the opening 14, for example, when the opening 14 does not contain a wire. This enables the lug 10 to firmly hold smaller diameter wires that would not normally contact the upper 36 and lower 37 edges of the sidewall 32 of the housing 12.

Although shown as having tabs protruding generally from the four corners of the clamping pad 16, other configurations are possible. For example, the clamping pad 16 may only include the upper mounting tabs 68 without the lower mounting tabs 72, or may include the lower mounting tabs 72 without the upper mounting tabs 68. Other variations are also possible, such as only having mounting tabs protruding from one side of the mounting pad, etc.

The upper tabs 68 and lower tabs 72 are separated from one another by a space 78. The space 78 can be configured and/or sized to receive the sidewalls 32 when the clamping pad 16 is assembled to the housing 12. The upper edge 34 and/or lower edge 36 of the sidewall 32 provide a track or guide along which the clamping pad 16 is slidable.

The clamping pad 16 includes a through hole 76 for receiving the moving mechanism 18. The through hole 76 may be tapped for engagement with the moving mechanism. The face 79 of the clamping pad 16 may have a textured surface or surface portion with any of a variety of surface texture elements to aid in gripping of a wire. For example, the face 79 may have a knurl pattern that may increase the friction used to hold the wire in place.

Rotation of the moving mechanism 18 causes longitudinal movement of the clamping pad 16 along the upper and lower edges 34, 36 of the housing 12. The tabs 68 and/or 72 inhibit and/or prevent rotation of the clamping pad 16 relative to the sidewalls 32 by engaging the upper 34 and/or lower 36 edges of the sidewalls 32 as the clamping pad 16 is driven by the moving mechanism 18 (FIG. 1). The clamping pad 16 therefore slides within the housing 12 between the sidewalls 32 along the upper and lower edges of the sidewalls, but does not rotate as it is moved between the unclamped and clamped positions.

Figure 6B:
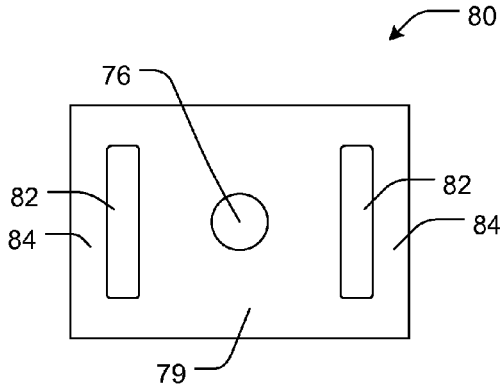
FIG. 6B is a side elevation view of another exemplary embodiment of a clamping pad.

An alternative clamping pad 80 is shown in FIG. 6B. The clamping pad 80 includes a pair of elongate through holes 82. The elongate holes 82 are configured to receive the sidewalls 32 of the housing 12 as the clamping pad 80 is assembled to the housing 12 and driven between the unclamped and clamped positions. The outer edge portions 84 of the elongate holes 82 may add structural rigidity to the clamping pad 80 so as to reduce or prevent rotation of the clamping pad 80 as it is moved between the unclamped and clamped positions. Similar to the clamping pad 16, the face 79 of the clamping pad 80 may have a textured surface or surface portion with any of a variety of surface texture elements to aid in gripping of a wire. For example, the face 79 may have a knurl pattern that may increase the friction used to hold the wire in place.

Figure 7:
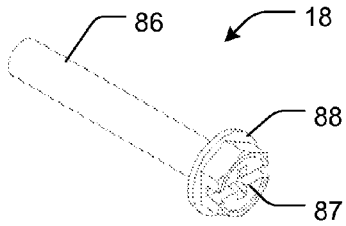
FIG. 7 is a perspective view of a moving mechanism.
Figure 8:
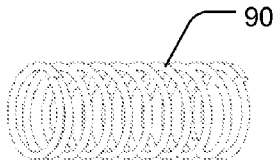
FIG. 8 is a perspective view of a resilient member.
Figure 9:
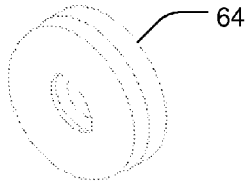
FIG. 9 is a perspective view of a rivet.

Referring now to FIGS. 7-9, the moving mechanism (FIG. 7), resilient member (FIG. 8) and rivet (FIG. 9) are shown.

In the exemplary embodiment of FIG. 7 and with additional reference to FIGS. 4 and 5A, the moving mechanism 18 is a drive screw, for example, a flanged hex head machine screw that screws into the rivet 64, which is installed into the hole 62 in the rear wall 48 of the housing 12. The moving mechanism 18 has as elongate portion 86, a head 87 and a flange 88. As shown in FIGS. 1-3, the elongate portion 86 is surrounded by a resilient member 90 (e.g., a compression spring), with the resilient member functioning as a positioning device that keeps the clamping pad 16 in place before and during installation.

The moving mechanism 18 has a fixed length that may be selected based upon the gauge of the wire to be received in the wire-receiving pocket 20. The length of the moving mechanism 18 may be long enough to allow a #14 through #6 AWG bare grounding wire (e.g., a solid or stranded wire) to slide into the wire-receiving pocket 20 while being short enough to allow an installation tool to install the mounting hardware without significant interference from the clamping pad 16 (FIG. 1). In one embodiment, the length of the drive screw is about 1.00 inch-1.1875 inches long. In a preferred embodiment, the length of the drive screw is about 1.0 inch, such that it is long enough to allow receipt of a #6 AWG stranded wire into the wire-receiving pocket 20.

The elongate portion 86 of the moving mechanism 18 is coupled to the housing 12 via the rear through hole 62. For example, the rear through hole 62 may be threaded for engagement to the moving mechanism 18 or configured to hold the rivet 64, with the moving mechanism 18 coupled to the housing 12 via the rivet 64. In one embodiment, the rivet is a spin rivet. The rivet allows the housing to be stamped from a thinner material while retaining an allowable amount of threads for proper screw clamping force.

The head 87 can allow for the use of a socket, flathead screwdriver and/or Phillips screwdriver to tighten the screw, thereby moving the clamping pad 16 from the unclamped position to the clamped position. The head of the drive screw may match the fastener 28, which allows an installer to use a single installation tool. The moving mechanism 18 also can be reverse-drivable so as to allow the clamping pad 16 to be moved from the clamped position to the unclamped position by driving the moving mechanism 18 in the opposite direction.

The clamping pad 16 is biased to the unclamped position by the resilient member, which is shown as a compression spring 90 in FIG. 8. The spring 90 is an installation aid and not necessarily a load-bearing feature of the grounding lug 10, although the spring 90 will bear a load from the clamping pad 16 as the clamping pad 16 is driven to the clamped position.

The spring 90 extends between the clamping pad 16 and the rear wall 48 of the housing 12. The spring 90 may press the clamping pad 16 against the flange 88 of the moving mechanism 18. For example, the spring 90 may be slightly compressed between the clamping pad 16 and the rear wall 48 or rivet 64 when the clamping pad 16 is in the unclamped position. As described below, the spring 90 can allow the clamping pad 16 to resiliently deflect towards the rear wall 48 of the housing 12 by the installer or installation tool during the mounting of the grounding lug onto the mount plate. Once installation is complete, the spring 90 causes the clamping pad 16 to deflect back to its original position. The spring 90 can therefore insure that a clearance gap remains for the grounding wire to slide between the clamping pad 16 and the housing 12.

During general use, the grounding lug 10 is inverted and installed on the bottom of an electrically conductive mounting surface of a piece of equipment or another component with hardware installed by a hand tool or a power tool. When installed, a grounding wire can be placed within the wire-receiving pocket 20 and held in location by resting on the clamping pad 16 and the housing 12 such that gravity does not cause the grounding wire to fall out of the wire-receiving pocket 20 when the grounding lug 10 is mounted underneath a mount plate.

An exemplary method for mounting the grounding lug 10 underneath a mount plate 92 (e.g., a PV module) is shown in FIGS. 10-14. Although shown as being mounted underneath an inclined mount plate 92, the grounding lug 10 can be mounted in other positions, including, for example, on a vertical portion, horizontal portion or other portion of the mount plate. The grounding lug 10 also can be mounted on the side or top of a module, as may be desired or necessary based upon the given environment in which the grounding lug is used. The grounding lug 10 also can be installed for applications other than grounding a PV module including, for example, grounding metallic raceways including rigid metal conduits and other exposed non-current carrying parts of equipment and enclosures. The lug can also be used in the telecommunications industry to bond cabinets, cable runways and telecom bus bars.

Figure 10:
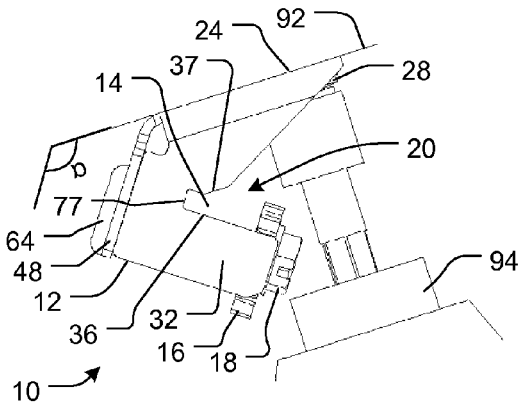
FIGS. 10-14 illustrate exemplary stages of mounting the grounding lug of FIG. 1 underneath a mount plate and clamping a grounding wire with the clamping pad.

With specific reference to FIG. 10, the grounding lug 10 is shown in an inverted position in which the base 24 of the housing 12 abuts the underside of the mount plate 92. The grounding lug 10 is coupled to the mount plate 92 by way of fastener 28, which is engaged to the mount plate 92, for example, by screwing the fastener 28 into the mount plate 92 with a tool 94, such as a drill. As shown in FIG. 10, due to the angle $\alpha$ between the base 24 and the rear wall 48 of the housing 12, the moving mechanism 18 is inclined relative to the mount plate 92, providing easier access to the moving mechanism 18 than if the rear wall 48 and the base 24 were perpendicular to one another, for example.

Figure 11:
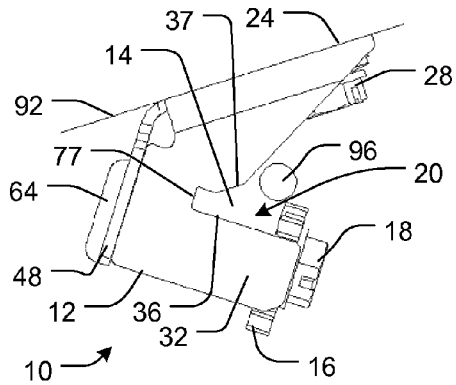

Referring now to FIG. 11, the grounding lug 10 is shown with the clamping pad 16 in its initial position relative to the sidewalls 32 of the housing 12 (e.g., the unclamped position). In the unclamped position, the clamping pad 16, in combination with the opening 14 in the housing 12, forms a wire-receiving pocket 20 for the wire 96. The clamping pad 16 is held in the unclamped position by the moving mechanism 18 such that there is a space between the clamping pad 16 and the rear wall 48 of the housing 12. The amount of space between the clamping pad 16 and the rear wall 48 can be adjusted by selecting a moving mechanism 18 having a longer or shorter elongate portion. The wire-receiving pocket 20 should provide a sufficiently large space for receiving the grounding wire 96. In one embodiment, the wire-receiving pocket 20 is sized for receipt of a #6 AWG stranded wire.

Figure 12:
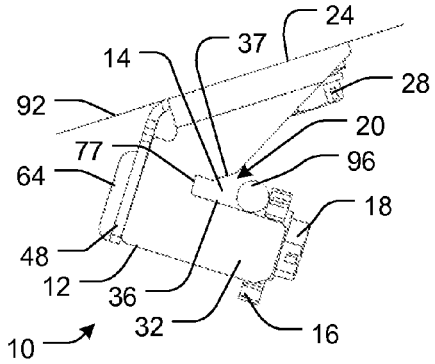

The wire 96 is slid into the wire-receiving pocket 20 as shown in FIG. 11. With the wire 96 placed in the wire-receiving pocket 20, the wire 96 is supported against gravity by the combination of the housing 12 and the clamping pad 16 as shown in FIG. 12. The grounding lug 10 can therefore support the wire 96 without having to first tighten the clamping pad 16 against the wire 96. This allows the installer freedom to adjust the position of the wire 96 without having to clamp and unclamp the wire from the grounding lug 10, thereby facilitating installation.

Figure 13:
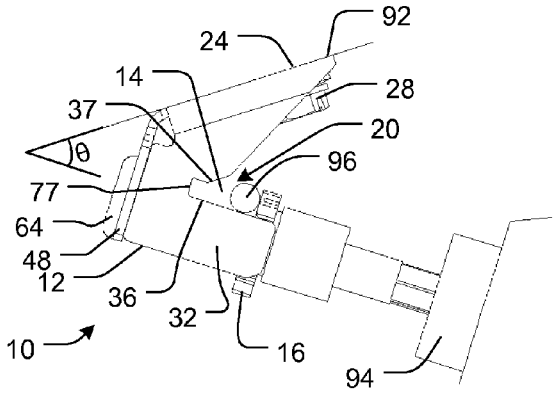

As shown best in FIG. 13, the angle $\theta$ between the opening 14 and the base 24 provides clearance between the base 24 and the moving mechanism 18 to facilitate access to the moving mechanism 18 during installation. The same tool 94 used to tighten the fastener 28 can be used to drive the moving mechanism 18 to move the clamping pad 16 between the unclamped position and the clamped position. The moving mechanism 18 can be tightened, for example, by driving it to a design torque, which may be based on the materials from which the grounding lug is constructed. In one embodiment, the design torque is about 15-35 in-lb.

Figure 14:
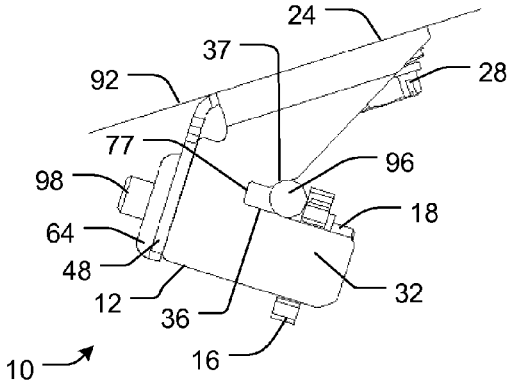

Driving the moving mechanism 18 causes the clamping pad 16 to move the wire 96 along a length of the opening 14 until it is clamped against the housing 12 by the clamping member 16 as shown in FIG. 14. The clamping pad 16 therefore securely connects the wire 96 to housing and creates an electrical path to ground when the clamping pad 16 is in the clamped position. In the clamped position, the grounding wire 96 is electrically coupled to the mount plate 92 through the housing 12 thereby electrically grounding the PV module. Also shown in FIG. 14, a distal end 98 of the moving mechanism 18 may extend from through the rear wall 48 of the housing 12 (e.g., through the rivet 64).

As will be appreciated, the grounding wire 96 can be released by driving the moving mechanism 18 in the opposite direction to move the clamping pad 16 to the unclamped position such that the clamping pad 16 and the housing 12 form the wire-receiving pocket 20 from which the wire can be removed, rearranged, replaced, etc.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A grounding lug comprising:

a housing defining an opening for receiving a wire;

a clamping pad movable relative to the housing between an unclamped position in which the clamping pad defines a wire-receiving pocket in combination with the opening defined by the housing, and a clamped position in which the clamping pad clamps the wire to the housing; and a moving mechanism coupled to the housing and the clamping pad for moving the clamping pad between the unclamped position and the clamped position.

2. The grounding lug of claim 1, wherein the opening is a slot.

3. The grounding lug of claim 2, wherein the housing includes a planar base and the slot is at an acute angle relative to the planar base.

4. The grounding lug of claim 3, wherein the acute angle is between 30° and 60°.

5. The grounding lug of claim 4, wherein the planar base has a hole therein for receiving a fastener for connecting the grounding lug to a mount plate.

6. The grounding lug of claim 2, wherein the wire travels along a length of the slot as the clamping pad is moved between the unclamped position and the clamped position.

7. The grounding lug of claim 1, wherein the clamping pad includes at least one tab that is slidable along an edge of the housing when the clamping pad is moved between the unclamped position and the clamped position.

8. The grounding lug of claim 7, wherein the edge along which the tab is slidable is an edge of a sidewall of the housing.

9. The grounding lug of claim 8, wherein the edge of the sidewall is a lower edge of the sidewall or an upper edge of the sidewall.

10. The grounding lung of claim 1, wherein the housing includes a sidewall having a lower edge and an upper edge, and wherein the clamping pad includes an upper tab slidable along the upper edge and a lower tab slidable along the lower edge.

11. The grounding lug of claim 1, wherein the housing includes a sidewall and the opening for receiving the wire is defined by the sidewall.

12. The grounding lug of claim 11, wherein the housing further includes a rear wall having a front face, wherein the sidewall includes a rear edge, and wherein the front face of the rear wall abuts the rear edge of the sidewall.

13. The grounding lug of claim 1, wherein the housing further includes a rear wall having a hole therein, and wherein the moving mechanism is coupled to the housing via the hole.

14. The grounding lug of claim 13, wherein the hole in the rear wall of the housing includes a threaded rivet therein, and wherein the moving mechanism is coupled to the housing via the threaded rivet.

15. The grounding lug of claim 1, further comprising a resilient member extending between the clamping pad and the housing, the resilient member biasing the clamping pad towards the unclamped position.

16. The grounding lug of claim 15, wherein the moving mechanism includes an elongate portion and a flange, and the resilient member is a compression spring that surrounds the elongate portion to resiliently bias the clamping pad against the flange of the moving mechanism.

17. The grounding lug of claim 16, wherein the moving mechanism is a drive screw.

18. The grounding lug of claim 1, wherein the wire-receiving pocket supports the wire against gravity when the clamping pad is in the unclamped position.

19. The grounding lug of claim 1, wherein the housing is stamped from sheet metal.

* * * * *